US012129784B2

(12) United States Patent
Byun et al.

(10) Patent No.: US 12,129,784 B2
(45) Date of Patent: Oct. 29, 2024

(54) COOLING FAN FOR VEHICLE

(71) Applicants: Hyundai Motor Company, Seoul (KR); Kia Corporation, Seoul (KR)

(72) Inventors: Hyung Suk Byun, Hwaseong-si (KR); Hwi Jae Lee, Suwon-si (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 0 days.

(21) Appl. No.: 18/072,084

(22) Filed: Nov. 30, 2022

(65) Prior Publication Data

US 2023/0358158 A1 Nov. 9, 2023

(30) Foreign Application Priority Data

May 9, 2022 (KR) ..... 1020220056366

(51) Int. Cl.
*B60L 50/00* (2019.01)
*F01P 5/04* (2006.01)

(52) U.S. Cl.
CPC ..... *F01P 5/04* (2013.01); *F01P 2005/046* (2013.01)

(58) Field of Classification Search
CPC .. F01P 2005/025; F01P 5/04; F01P 2005/046; F04D 25/166; F04D 29/5806; F04D 29/5813; F04D 29/58; F04D 29/38; F04D 29/263; F28D 1/024
See application file for complete search history.

(56) References Cited

U.S. PATENT DOCUMENTS 4,352,635 A * 10/1982 Saunders ..... F01P 5/04 417/16
5,242,013 A * 9/1993 Couetoux ..... F01P 5/04 165/122
2006/0137956 A1* 6/2006 Boffeli ..... F01P 7/048 192/48.2

(Continued)

FOREIGN PATENT DOCUMENTS

CN 104617745 A * 5/2015
CN 109245400 A * 1/2019

(Continued)

OTHER PUBLICATIONS https://www.youtube.com/watch?v=tgnkhSWQ7mg: "How to Have Two Motors on a Single Axis Spinning in Opposite Directions on a CNC Machine" (Year: 2015).*

*Primary Examiner* — George C Jin
*Assistant Examiner* — Teuta B Holbrook
(74) *Attorney, Agent, or Firm* — Fish & Richardson P.C.

(57) ABSTRACT

A cooling fan for a vehicle is configured to suction air from a cooling module for the vehicle and to allow the suctioned air to pass through a heat exchanger of the cooling module. The cooling fan includes an electric motor, a blade rotated with the rotational force of the electric motor to suction air, and a power transmission mechanism disposed between an output shaft of the electric motor and a central axis of the blade to transmit the rotational force of the electric motor to the blade, wherein the electric motor includes a first motor and a second motor such that a rotor shaft of the first motor and a rotor shaft of the second motor are connected to transmit rotational force, so that rotational force components of the first motor and the second motor are combined through the two rotor shafts and output through the output shaft.

13 Claims, 7 Drawing Sheets

(56) References Cited

U.S. PATENT DOCUMENTS

| | | | | |
|---|---|---|---|---|
| 2015/0318812 | A1* | 11/2015 | O'Donnell | B60L 50/16 310/78 |
| 2021/0372506 | A1* | 12/2021 | McGrew, Jr. | F16H 3/725 |
| 2022/0021270 | A1* | 1/2022 | Yoo | F16D 1/10 |

FOREIGN PATENT DOCUMENTS

| | | | | | |
|---|---|---|---|---|---|
| CN | 113323899 | A | * | 8/2021 | |
| CN | 113513787 | A | * | 10/2021 | |
| DE | 3838868 | A1 | * | 8/2020 | |
| DE | 102019001047 | A1 | * | 8/2020 | |
| EP | 3647101 | B1 | * | 4/2022 | B60K 6/24 |
| FR | 2713704 | A1 | * | 6/1995 | F01P 5/04 |
| JP | 2018047801 | A | * | 3/2018 | |
| KR | 20080025452 | A | * | 3/2008 | |

* cited by examiner

RELATED ART

COOLING FAN FOR VEHICLE

CROSS-REFERENCE TO RELATED APPLICATION

This application claims under 35 U.S.C. § 119(a) the benefit of priority to Korean Patent Application No. 10-2022-0056366, filed on May 9, 2022, the entire contents of which are incorporated herein by reference.

TECHNICAL FIELD

The present disclosure relates to a cooling fan for a vehicle and, more particularly, to a cooling fan that is mounted on a heat exchanger in a vehicle to introduce air to allow the introduced air to pass through the heat exchanger.

BACKGROUND

A fuel cell electric vehicle (FCEV) is a vehicle that is driven by an electric motor such as a battery electric vehicle (BEV), wherein a fuel cell and a high-voltage battery are used as a main power source and an auxiliary power source, respectively, to supply drive power to the electric motor as a vehicle driving source.

A fuel cell, which is the main power source in an FCEV, is a kind of power generator that converts chemical energy of fuel into electrical energy by electrochemically reacting fuel gas and oxidizing gas.

As a fuel cell for a vehicle, a polymer electrolyte membrane fuel cell (PEMFC) having a high power density has been widely used. A PEMFC uses hydrogen as a fuel gas among reactive gases, and oxygen or air containing oxygen as an oxidizing gas.

A fuel cell includes a plurality of cells that generate electric energy by reacting a fuel gas and an oxidizing gas, wherein the electricity-generating cells are generally stacked and serially connected together into a stack to satisfy an output level.

As a fuel cell mounted on a vehicle also may have a high output, hundreds of cells that individually generate electrical energy are stacked in a stack to satisfy the output level. A cell assembly in which a plurality of cells is stacked and connected as described above is referred to as a fuel cell stack.

A fuel cell system mounted on a fuel cell vehicle includes such a fuel cell stack, a device for supplying a reactive gas to the fuel cell stack, and devices for managing states of the fuel cell stack.

In detail, the fuel cell system includes a fuel cell stack for generating electric energy from an electrochemical reaction of a reactive gas, a hydrogen supply device for supplying hydrogen as a fuel gas to the fuel cell stack, and an air supply device for supplying air containing oxygen as an oxidizing gas to the fuel cell stack, a heat and water management unit for controlling an operating temperature of the fuel cell stack and managing heat and water, and a fuel cell control unit (FCU) for controlling the entire operation of the fuel cell system.

In addition, a power net system of a fuel cell vehicle includes a fuel cell stack serving as a main power source of the vehicle, a high voltage battery serving as an auxiliary power source of the vehicle, a converter (Bidirectional High Voltage DC-DC Converter: BHDC) connected to the battery to control the output of the battery, an inverter connected to the fuel cell stack and a DC link terminal (main bus terminal) that is an output side of the battery, and a driving motor connected to the inverter.

In some examples, as a measure to overcome the problem of battery capacity in large-scale electric vehicles such as trucks, buses, etc., a hydrogen electric truck or bus equipped with a fuel cell has been actively developed.

Commercial fuel cell vehicles such as hydrogen electric trucks are equipped with a power plant composed of a plurality of fuel cell systems (hereinafter referred to as 'Power Module Complete (PMC)') applied to passenger fuel cell vehicles. That is, the commercial fuel cell vehicle is equipped with the plurality of PMCs, which each include a fuel cell stack, a stack operating device, and components of a water cooling system for cooling the fuel cell stack.

Here, the components of the cooling system in the PMC are those including an electric water pump and valves, except for a radiator. The radiator for cooling the stack through which heat from cooling water that has cooled the fuel cell stack dissipates is separately disposed at the front side of a vehicle body together with a cooling fan, and the radiator for cooling the stack and the plurality of components of the cooling system in the PMC are connected together through cooling water lines (pipes) to allow the cooling water to circulate.

In the case of a hydrogen electric truck, two fuel cell stacks, which are each applied to a passenger fuel cell vehicle, can be mounted to ensure a vehicle driving output. In some examples, the cooling system in each PMC may be connected in series to a single radiator through a coolant line (pipe), and the cooling systems of the two PMCs may be connected in parallel to the radiator through a coolant line.

In addition, where a plurality of high-output fuel cell stacks are mounted on a hydrogen electric truck, since the amount of heat generated from the fuel cell stack is greatly increased, the cooling performance can be satisfied only by increasing the number of cooling modules each including a radiator and a cooling fan at the front side of the vehicle body.

However, it is difficult to secure sufficient space for mounting a plurality of cooling modules in a vehicle in consideration of the interior space and arrangement of peripheral components (a steering device, a lamp, a step, etc.) with respect to a vehicle package. Therefore, a large-scale radiator is used by increasing the size of the radiator.

Hereinafter, the conventional problems will be described in more detail.

In the water cooling system of the hydrogen electric truck, the radiator and the cooling fan that constitute the cooling module may be mounted on the front side of the vehicle body. Specifically, in the hydrogen electric truck, a stack radiator and a power electronics (PE) component radiator may be mounted on the front side of the vehicle body, and a cooling fan may be mounted on the rear side of the radiator.

The stack radiator is a stack-cooling radiator for heat-dissipation of cooling water that has cooled the fuel cell stack, and the PE component radiator is a radiator for heat-dissipation of coolant that has cooled the PE components. Here, the PE components may be a motor as a vehicle driving source, an inverter for driving the motor, and the like.

In the hydrogen electric truck, a radiator grill is provided on the front side of the vehicle body as an air inlet through which air (external air) can be introduced from the front side, and the air introduced through the radiator grill sequentially passes through the radiator and the cooling fan.

In the conventional hydrogen electric truck, although the air introduced through the radiator grill on the front side of the vehicle body may flow through the radiator and the cooling fan in a rearward direction, a portion of the air collides with parts behind the cooling fan and flows in the reverse direction after passing through the radiator and the cooling fan, which is problematic.

Moreover, large-scale commercial fuel cell vehicles such as hydrogen electric trucks adopt hydraulically driven cooling fans, which may include hydraulic motors, oil tanks, oil coolers, hydraulic pumps, etc., as well as complex piping such as oil hoses, or the like.

In a vehicle to which such a hydraulically driven cooling fan is applied, a complex oil hose is usually placed at the rear of the cooling fan along with a hydraulic motor, an oil tank, and an oil cooler, so there is a problem in that parts of the hydraulically driven cooling fan block the airflow behind the radiator and the cooling fan. As a result, the high-temperature air that has received heat from cooling water in the radiator during circulation through the radiator collides with the piping such as the oil hose behind the cooling fan and then flows in the reverse direction.

For example, when the oil tank is located in the left portion behind the cooling fan on the vehicle front side, along with the complex oil hose, a large amount of air that has passed through the radiator and the cooling fan may collide with the oil hose and the oil tank in the left portion behind the cooling fan and then flow in the reverse direction.

Such a high-temperature backflow air recirculates by flowing to the front side of the radiator and then passing through the radiator again, which causes a problem of deteriorated cooling performance of the radiator.

In addition, the hydraulic pump for supplying hydraulic pressure at high pressure to the hydraulic motor rotating blades of the cooling fan includes a pump motor (electric motor) and an electric motor for driving the pump motor. Accordingly, in the hydraulically driven cooling fan, the hydraulic pump generates a high-pressure hydraulic pressure and supplies the same to the hydraulic motor through an oil pipe to rotate the blades of the cooling fan.

However, unlike the hydraulic motor, the oil tank, and the oil cooler installed around the stack radiator, it is difficult to secure an installation space for the pump motor and the electric motor around the stack radiator at the vehicle front side. Thus, such a hydraulic pump is mounted on the lateral side of a hydrogen electric truck, so a long oil pipe may connect the hydraulic pump and the hydraulic motor.

As such, a vehicle to which a hydraulically driven cooling fan is applied has various problems such as increased number of parts, excessive weight, and difficulty in securing an installation space, as well as high flow resistance of air passing through the radiator and the cooling fan, and air recirculation to the radiator due to an air backflow. In addition, since the efficiency of the hydraulic components is not enough, there is another problem of deterioration in vehicle fuel efficiency.

To overcome these problems, instead of the hydraulic cooling fan, an electric cooling fan may be applied. In such an electric cooling fan, since blades thereof are directly connected to a rotation shaft of an electric motor to rotate with the rotational force of the electric motor, the conventional complicated hydraulic components disposed behind the cooling fan may be omitted.

However, in large-scale commercial fuel vehicles such as hydrogen electric trucks, since the size and air passage area of the stack radiator through which air passes are very large, there is a need for a large-scale electric cooling fan, and if the size of a blade of such a large-scale electric cooling fan is increased, a high power electric motor may be developed.

If an electric motor with insufficient power rather than high power is used alone, the rotation speed of the blades is inevitably limited due to insufficient torque to rotate the blades, which makes it difficult to satisfy sufficient cooling performance due to insufficient rotation speed of the blades.

Therefore, instead of developing a high power electric motor, the application of a dual fan using two blades (fans) and two motors may be considered. However, when such a dual fan is applied, more than 30% of power consumption may secure the same cooling performance, which adversely affects the power performance and fuel efficiency of a vehicle.

Furthermore, as illustrated in FIG. 1, when a dual fan is applied, a dead zone having a small amount of air volume is generated in a core of the radiator, which may result in additional cooling performance deterioration.

SUMMARY OF THE DISCLOSURE

The present disclosure has been made in an effort to solve the above-described problems associated with the related art, and an objective of the present disclosure is to provide a high-power electric cooling fan capable of obtaining sufficient air volume and cooling performance when applied to a large-area radiator while even using a single fan (blade) that can minimize the dead zone.

The objective of the present disclosure is not limited to that mentioned above, and other objectives not mentioned are clearly understood by those of ordinary skill in the art (hereinafter referred to as 'person of ordinary skill')., to which the present disclosure belongs, from the description below.

In order to achieve the above objective, according to an aspect of the present disclosure, there is provided a cooling fan for a vehicle for suctioning air from a cooling module for a vehicle to allow the suctioned air to pass through a heat exchanger of the cooling module, the cooling fan including: an electric motor; a blade rotated with the rotational force of the electric motor to suction air; and a power transmission mechanism disposed between an output shaft of the electric motor and a central axis of the blade to transmit the rotational force of the electric motor to the blade, wherein the electric motor includes a first motor and a second motor such that a rotor shaft of the first motor and a rotor shaft of the second motor are connected to transmit rotational force, so that rotational force components of the first motor and the second motor are combined through the two rotor shafts and output through the output shaft.

As such, according to the vehicle cooling fan of the present disclosure, it is possible to drive the fan (blade) at high speed and high power and to, when applied to a large-scale radiator, obtain sufficient air volume and cooling performance, using the electric motor while even using a single fan (blade) that can minimize the dead zone.

Compared to the conventional case of applying a hydraulically driven cooling fan for a large-scale radiator, complex hydraulic parts can be omitted, so there are several advantages such as reduction in the number of parts, weight reduction, improvement of a packaging feature, and ease of securing an installation space.

In particular, as a number of hydraulic components disposed behind the cooling fan are eliminated, it is possible to improve both the flow resistance of air having passed through the radiator and the cooling performance. In addition, compared to a hydraulically driven cooling fan, driving efficiency is improved to minimize consumed fan output and improve vehicle fuel efficiency.

DETAILED DESCRIPTION

Hereinafter, implementations of the present disclosure will be described in detail with reference to the accompanying drawings. Specific structural or functional descriptions presented in the implementations of the present disclosure are only exemplified for the purpose of describing implementations according to the concept of the present disclosure, which may be carried out in various forms. Further, the present disclosure should not be interpreted as being limited to the implementations described herein, and should be understood as including all modifications, equivalents, and substitutes included in the spirit and scope of the present disclosure.

The present disclosure is directed to a cooling fan used in a cooling module of a vehicle, and more particularly, to a cooling fan that suctions air from a cooling module of a vehicle to allow the suctioned air to pass through a heat exchanger.

The cooling fan according to the present disclosure is an electric cooling fan using an electric motor as a driving source. Particularly, the cooling fan is a single fan-type cooling fan having one large-scale blade (fan) and an electric motor for rotating the blade.

The heat exchanger of the cooling module to which the cooling fan according to the present disclosure is mounted may be a radiator for heat exchange between cooling water of a vehicle and air. In addition, the cooling fan according to the present disclosure may be mounted on a large-scale radiator having the large size and the large air passage area. For example, the cooling fan may be a cooling fan mounted on a stack radiator at the front end of a large-scale commercial fuel cell vehicle such as a hydrogen electric truck.

The present disclosure provides a high-power electric cooling fan capable of obtaining sufficient air volume and cooling performance when applied to a large-area radiator while even using a single fan (blade) configuration that can minimize a dead zone where there is insufficient air volume in a radiator core.

Figure 1:
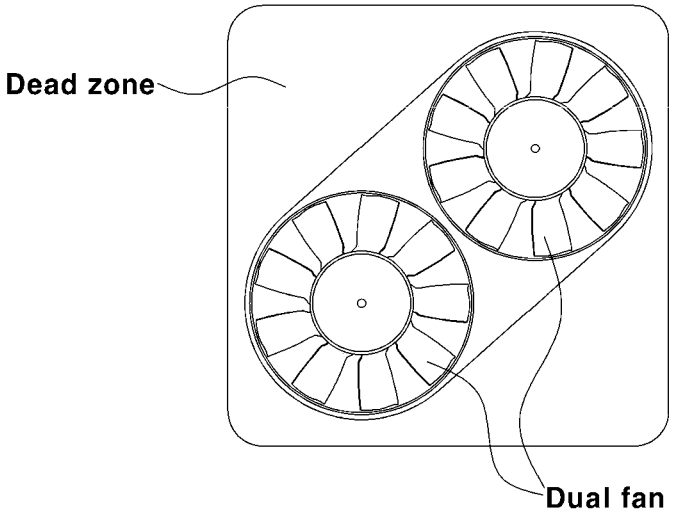
FIG. 1 is a diagram illustrating a dual fan in related art.
Figure 2:
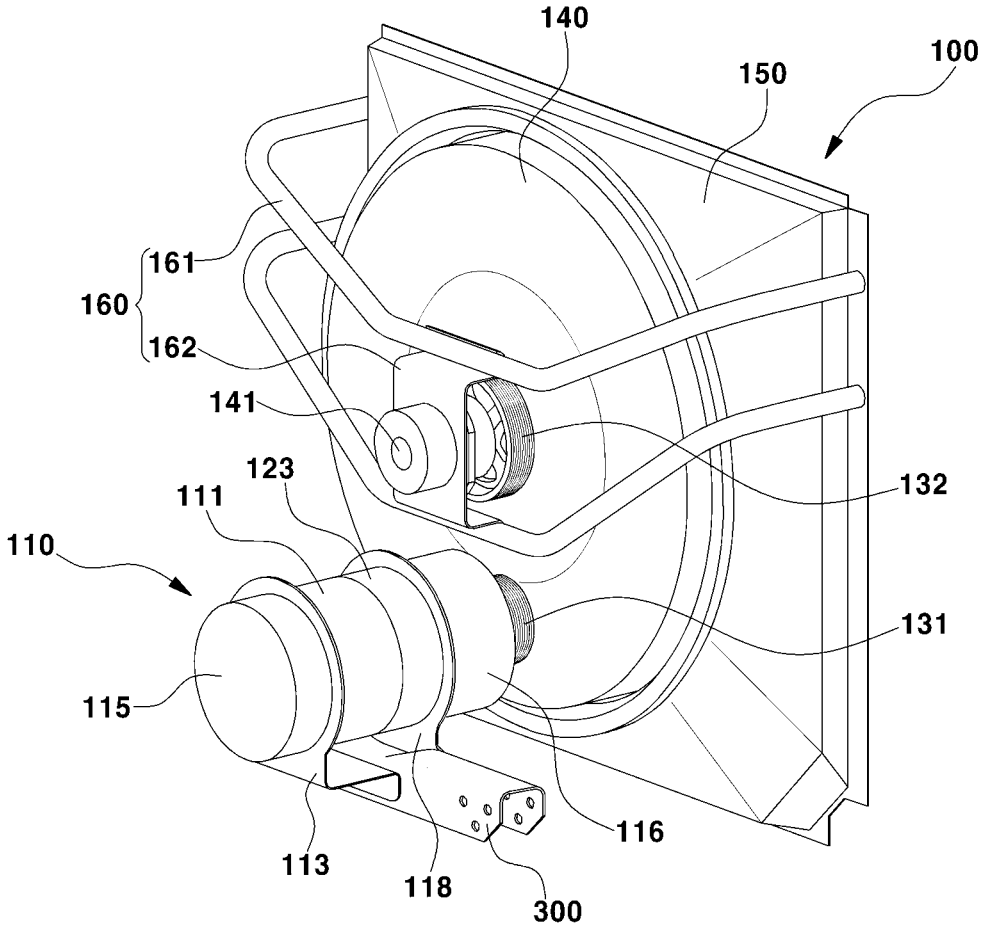
FIG. 2 is a perspective view illustrating an example of a cooling fan.
Figure 3:
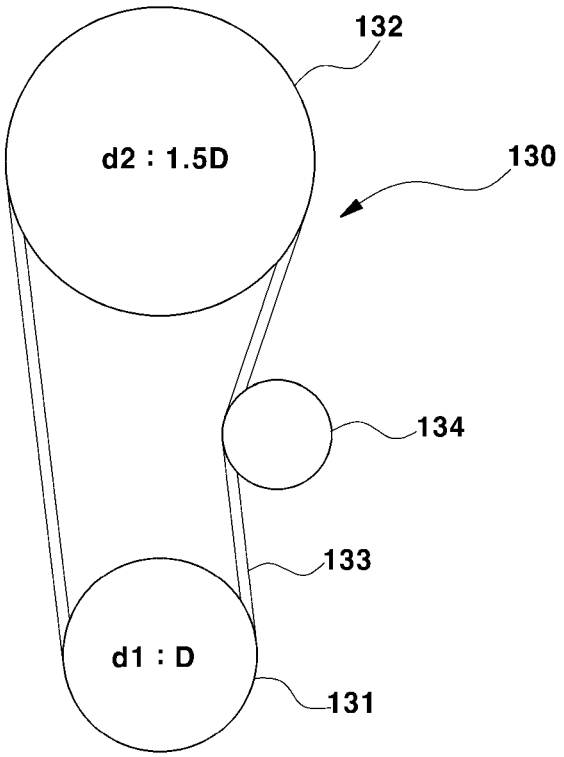
FIG. 3 is a schematic diagram illustrating an example of a belt pulley device as an overdrive power transmission mechanism in the cooling fan.
Figure 4:
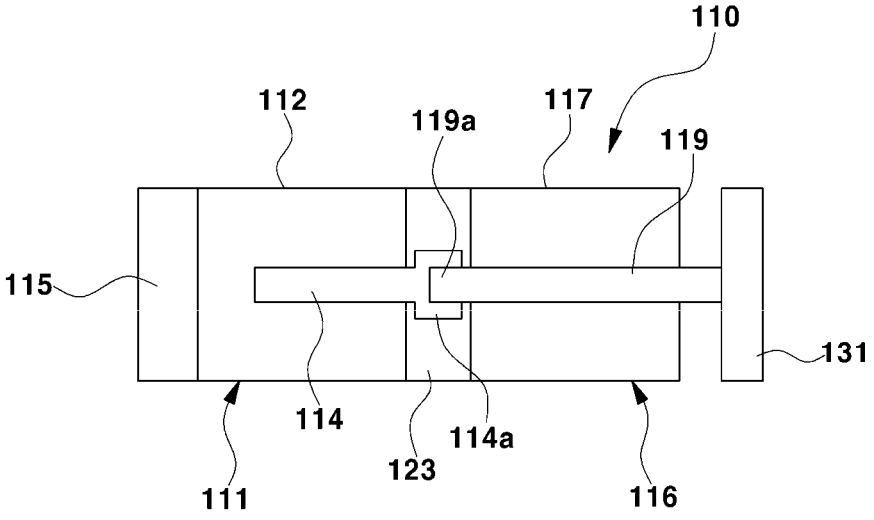
FIG. 4 is a schematic diagram illustrating a connection structure of a rotor shaft between motors in the cooling fan.

Referring to the drawings, FIG. 2 is a perspective view illustrating a cooling fan, FIG. 3 is a schematic diagram illustrating a belt pulley device as an overdrive power transmission mechanism in the cooling fan, and FIG. 4 is a schematic diagram illustrating a connection structure of a rotor shaft between motors in the cooling fan.

The cooling fan 100 includes a driving device, a blade 140 rotated by the driving device, and a shroud 150 mounted around the blade 140.

For examples, the driving device of the cooling fan 100 may include an electric motor 110, and the cooling fan 100 may further include a power transmission mechanism 130 for transmitting the rotational force of the electric motor 110 to the blade 140.

In some implementations, in the cooling fan 100, the electric motor 110 of the driving device has a dual motor configuration. Specifically, the electric motor 110 is configured to include two motors arranged in series back and forth, that is, a first motor 111 and a second motor 116. In addition, the electric motor 110 has a single output shaft via which the rotational force and torque of the two motors 111 and 116 are combined and output.

To this end, a rotor shaft 114 of the first motor 111 and a rotor shaft 119 of the second motor 116 are connected to each other to transmit rotational force. In the electric motor 110, the rotor shaft 114 or 119 of the motor 111 or 116 is a shaft integrally coupled to a rotor of the corresponding motor, i.e., a rotation shaft or a driving shaft via which rotational force is output with interaction between the rotor and a stator.

In addition, in the cooling fan 100, inverters 115 and 123 are integrally mounted on the motors 111 and 116, respectively, of the driving device to drive and control the corresponding motor (see FIG. 2). In some examples, respective inverters 115 and 123 may be integrally coupled to the rear surfaces of motor housings 112 and 117 of the corresponding motors 111 and 116 (see FIG. 4).

Hereinafter, in the description of the implementations of the present disclosure, the 'front' and 'rear' of any space or element refer to the position with respect to the front-rear direction of a vehicle unless otherwise specifically defined and distinguished.

Referring to FIG. 2, the first motor 111 and the second motor 116 are disposed on the rear side and the front side, respectively, such that the rotor shaft 119 of the second motor 116 is connected to the blade 140 in a rotational force-transmissible manner by means of the power transmission mechanism 130 illustrated in FIG. 3.

In the cooling fan 100, two motors, i.e., the first motor 111 and the second motor 116, constituting the electric motor 110 of the driving device may have a structure in which the rotor shafts 114 and 119 of the first motor 111 and the second motor 116 are directly connected to each other so as to rotate integrally.

In some examples, one or both of the rotor shafts 114 and 119 of the two motors 111 and 116 are disposed to pass through the inverter 123 mounted on the rear surface of the motor housing 117 of the second motor 116 (see FIG. 4).

Referring to FIGS. 2 and 4, it can be seen that the inverter 123 for driving and controlling the second motor 116 is located in a space between the two motors 111 and 116, and in this structure, the rotor shafts 114 and 119 of the two motors 111 and 116 are connected in a state of passing through the inverter 123 of the second motor 116.

In addition, shaft coupling parts 114*a* and 119*a* are integrally formed on the rotor shafts 114 and 119 of the two motors 111 and 116 at interconnection ends, respectively. That is, the shaft coupling parts 114*a* and 119*a* are integrally formed at one end (front end) of the rotor shaft 114 of the first motor 111 and one end (rear end) of the rotor shaft 119 of the second motor 116, respectively, wherein the shaft coupling parts 114*a* and 119*a* of both the two rotor shafts 114 and 119 are directly connected and coupled in a power-transmissible manner.

In some examples, the shaft coupling parts 114*a* and 119*a* of the two rotor shafts 114 and 119 may be connected and coupled to rotate integrally with each other by a spline coupling structure. That is, as illustrated in FIG. 4, one of the shaft coupling parts of the two rotor shafts 114 and 119 is provided as a female coupling part 114*a* and the other shaft coupling part of the rotor shaft is provided as a male coupling part 119*a* such that the male coupling part 119*a* is inserted into and spline-coupled to the female coupling part 114*a* so that the two rotor shafts 114 and 119 on both sides are connected to rotate integrally.

Referring to FIG. 4, it can be seen that the female coupling part 114*a* is integrally formed on the front end of the rotor shaft 114 of the first motor 111, and the male coupling part 119*a* is integrally formed on the rear end of the rotor shaft 119 of the second motor 116. In addition, it can also be seen that the male coupling part 119*a* is inserted into and spline coupled to the female coupling part 114*a* so that the two rotor shafts 114 and 119 on both sides are directly connected to each other in a power-transmissible manner.

In the spline coupling structure, teeth are formed on the inner circumferential surface of the female coupling part 114*a* and teeth are formed on the outer circumferential surface of the male coupling part 119*a* so that the two rotor shafts 114 and 119 on both sides rotate integrally by the mutual teeth-engagement state, i.e., the mutual teeth-meshed state, between the male coupling part 119*a* and the female coupling part 114*a*.

In some examples, as illustrated in FIG. 2, a fan mounting bracket 160 is mounted on the shroud 150 of the cooling fan 100, or a not-illustrated mounting member (reference numeral '210' in FIG. 6) to which the shroud 150 is fixedly coupled, and the central shaft 141 of the blade 140 is rotatably coupled to the fan mounting bracket 160.

Here, the mounting member (reference numeral '210' in FIG. 6) is a member that fixes and mounts a heat exchanger disposed in front of the cooling fan 100, for example, a stack radiator (reference numeral '200' in FIG. 6) on a body frame so that the blade 140 is rotatably supported by means of the fan mounting bracket 160.

In addition, the fan mounting bracket 160 is configured to include a plurality of rods 161 horizontally arranged to connect left and right lateral ends of the shroud 150 or the left and right lateral ends of the mounting member (reference numeral '210' in FIG. 6), and a bracket body 162 that is fixedly mounted on the plurality of rods 161.

The central shaft 141 of the blade 140 is coupled to the bracket body 162 to be rotatably supported by means of a bearing, and the power transmission mechanism 130 is configured between the central shaft 141 of the blade 140 and the output shaft of the electric motor 110, specifically, between the central shaft 141 of the blade 140 and the rotor shaft 119 of the second motor 116.

Further, as illustrated in FIG. 2, the first motor 111 and the second motor 116 are mounted on a cross member 300, which is a body part arranged to extend long in the left and right direction of a vehicle, by means of separate brackets 113 and 118. In addition, the cross member 300 is coupled to vehicle body frames by means of separate fixing brackets.

The body frames are body parts arranged on left and right sides of a vehicle body so as to extend long in the front-rear direction of a vehicle. In some examples, a vehicle may include a cooling module including a radiator (reference numeral '200' in FIG. 6), and a cooling fan 100 may be mounted on and fixedly supported by the body frame by means of a mounting member (reference numeral '210' in FIG. 6).

In some examples, the cross member 300 is mounted to connect the left and right body frames at the front end of a vehicle body.

Further, the cross member 300 may be mounted on and supported by the left and right body frames by means of fixing brackets, wherein the fixing brackets may be respectively coupled to the front sides of the two left and right body frames, and the ends of the cross member 300 may be respectively coupled to the left and right fixing brackets. That is, left and right ends of the cross member 300 are respectively coupled to the front sides of the two body frames by means of the two fixing brackets on the left and right sides.

In some examples, two motors constituting the electric motor 110, that is, the first motor 111 and the second motor 116, have a dual motor configuration in which respective rotor shafts thereof 114 and 119 are connected to rotates integrally with each other, so that the rotational force and torque output by the two motors 111 and 116 are combined and output via a single rotor shaft 119 which is a final output shaft.

In the electric motor 110 of the illustrated implementation, the rotor shaft 119 of the second motor 116 is the final output shaft, and thus the rotational force is finally output via the rotor shaft 119 of the second motor 116 and transmitted to the blade 140 via the power transmission mechanism 130.

In addition, in some implementations, the power transmission mechanism 130 may be a belt-type power transmission mechanism. To this end, a belt pulley device is configured between the final output shaft of the electric motor 110, i.e., the rotor shaft 119 of the second motor 116, and the central shaft 141 of the blade 140.

As illustrated in FIGS. 2 and 3, the belt pulley device may include a motor-side pulley 131 mounted on the rotor shaft 119 of the second motor 116, a fan-side pulley 132 mounted on the central shaft 141 of the blade (fan) 140, and a belt 133 that connects the motor-side pulley 131 and the fan-side pulley 132 in a power-transmissible manner therebetween.

In the electric motor 110 having the dual motor configuration in the present disclosure, the power transmission mechanism 130 having an overdrive function may be applied to increase the torque output from the electric motor 110 and transmit the increased torque to the blade 140. In order to implement the above-described overdrive function, pulleys for overdrive are used in a belt pulley device, which is a belt-type power transmission mechanism.

That is, in the belt pulley device, the motor-side pulley 131 and the fan-side pulley 132 which have a predetermined diameter ratio are used, and in this case, a diameter d2 of the fan-side pulley 132 is set to be larger than a diameter d1 of the motor-side pulley 131 ($d2>d1$) to implement the overdrive function. For example, if the diameter d1 of the motor-side pulley 131 is D, the diameter d2 of the fan-side pulley 132 may be 1.5D (i.e., $d2=1.5D=1.5d1$).

In this case, the torque transmitted from the electric motor 110 to the blade (fan) 140 via the motor-side pulley 131 and the fan-side pulley 132 may be increased. To this end, the diameter d2 of the fan-side pulley 132 may be larger than the diameter d1 of the motor-side pulley 131 to increase the torque transmitted to the blade 140.

The torque acting on the blade 140 via the fan-side pulley 132 may be expressed by Equation 1 below.

$$T_{Fan}=T_{Motor}\times(d2/d1)(\text{where } d2>d1) \quad \text{[Equation 1]}$$

Here, $T_{Fan}$ is a torque transmitted to the fan-side pulley 132, and represents a torque acting on the blade 140, and $T_{Motor}$ represents a torque of the motor-side pulley 131. In addition, d1 represents the diameter of the motor-side pulley 131, and d2 represents the diameter of the fan-side pulley 132.

In addition, in case the belt-type power transmission mechanism, that is, the belt pulley device as described above, is used as the power transmission mechanism 130, if the tension of the belt 133 falls below a specified value, the torque transmission performance is reduced, and friction occurring due to the slippage of the belt is converted into heat, which may reduce the durability of the belt and may generate noise.

Accordingly, an auto tensioner 134 that contacts and presses the belt 133 is provided so as to keep the tension of the belt constant and to absorb a change in tension caused by a sudden change in torque of the motor. The auto tensioner 134 may be rotatably installed on a rod 161 of the fan mounting bracket 160 via a separate bracket or the like or may be rotatably installed on a separate fixed structure positioned around the belt 133.

Figure 5:
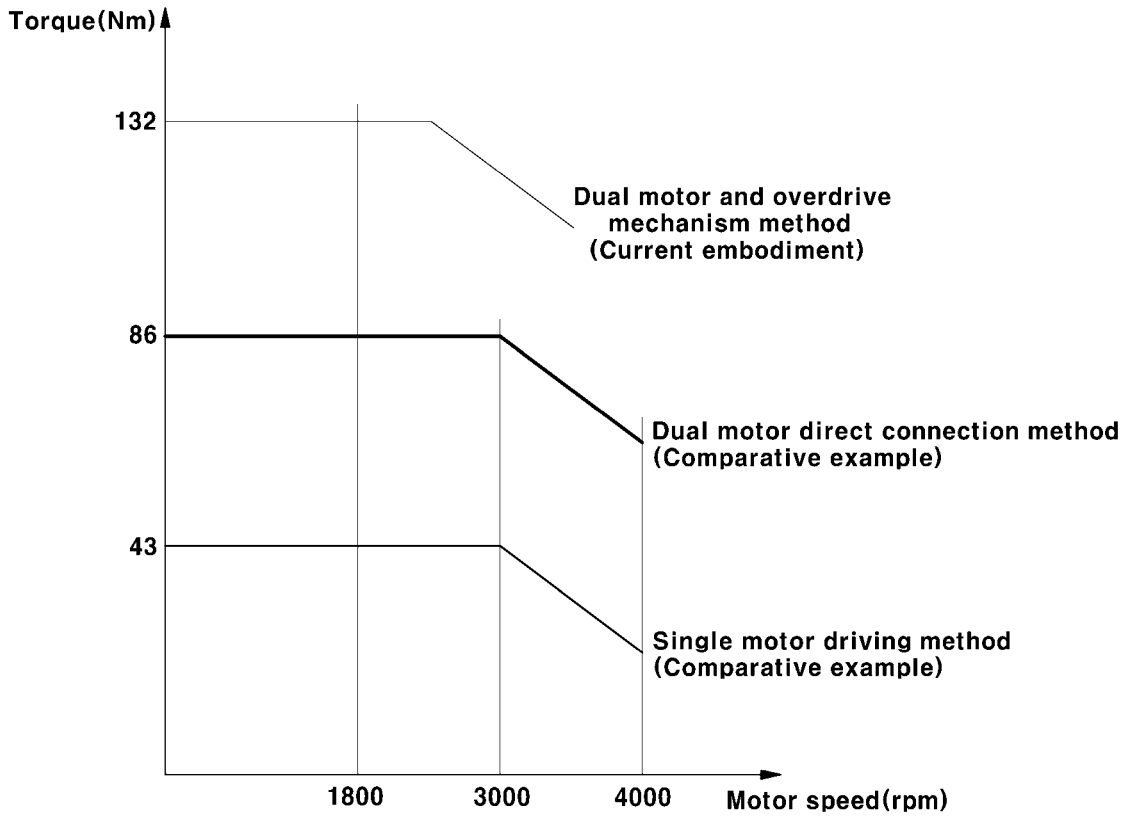
FIG. 5 is a diagram illustrating comparison between the outputs of a single motor driving method, a dual motor direct connection method, and a dual motor and an overdrive mechanism method.

FIG. 5 is a diagram illustrating comparison between the outputs of a single motor driving method, a dual motor direct connection method, and a dual motor and an overdrive mechanism method. The dual motor and overdrive mechanism method is a method applied to the example shown in FIGS. 2 to 4.

In the comparative examples, the single motor driving method is a method in which a single motor is used such that a central shaft of a blade is directly connected to a rotor shaft of the single motor, whereas the dual motor direct connection method is a method in which a central axis of a blade is directly connected to a rotor shaft of a second motor without an overdrive mechanism, i.e., a belt pulley device that is a power transmission mechanism.

As can be seen from FIG. 5, in the cooling fan, with the application of the dual motor and overdrive mechanism, a blade (fan) can be driven at target high-output and high-speed, though the speed is somewhat reduced compared to a motor speed.

Figure 6:
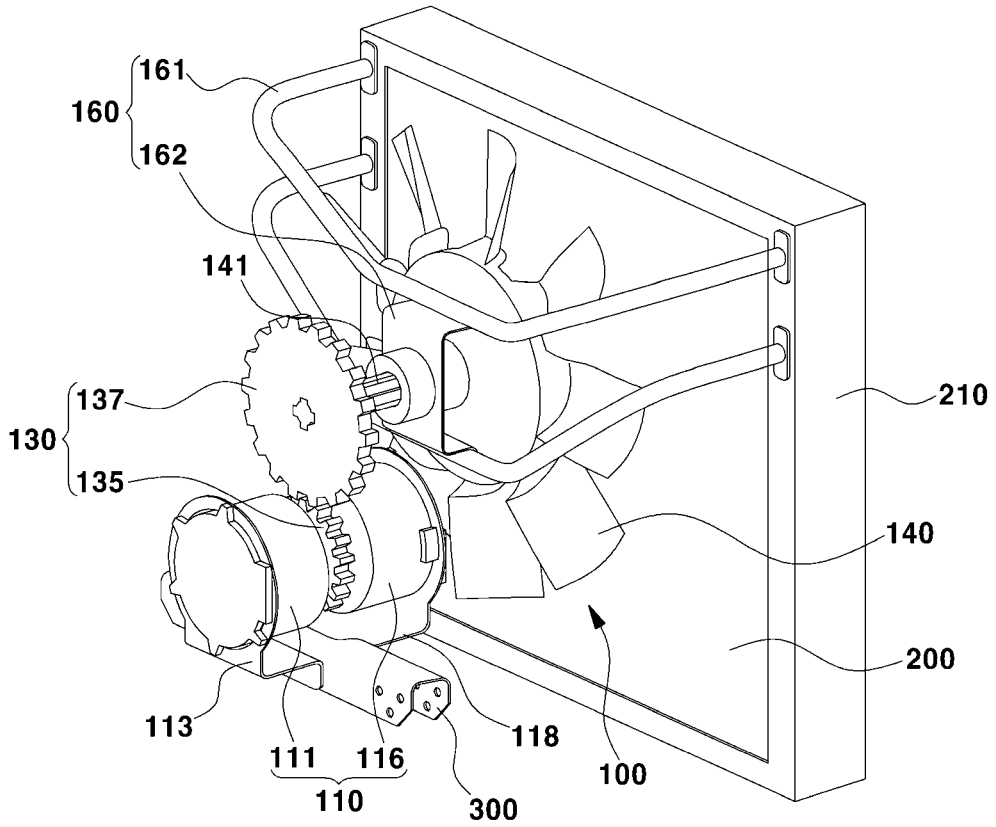
FIG. 6 is a perspective view illustrating an example of a cooling fan.
Figure 7:
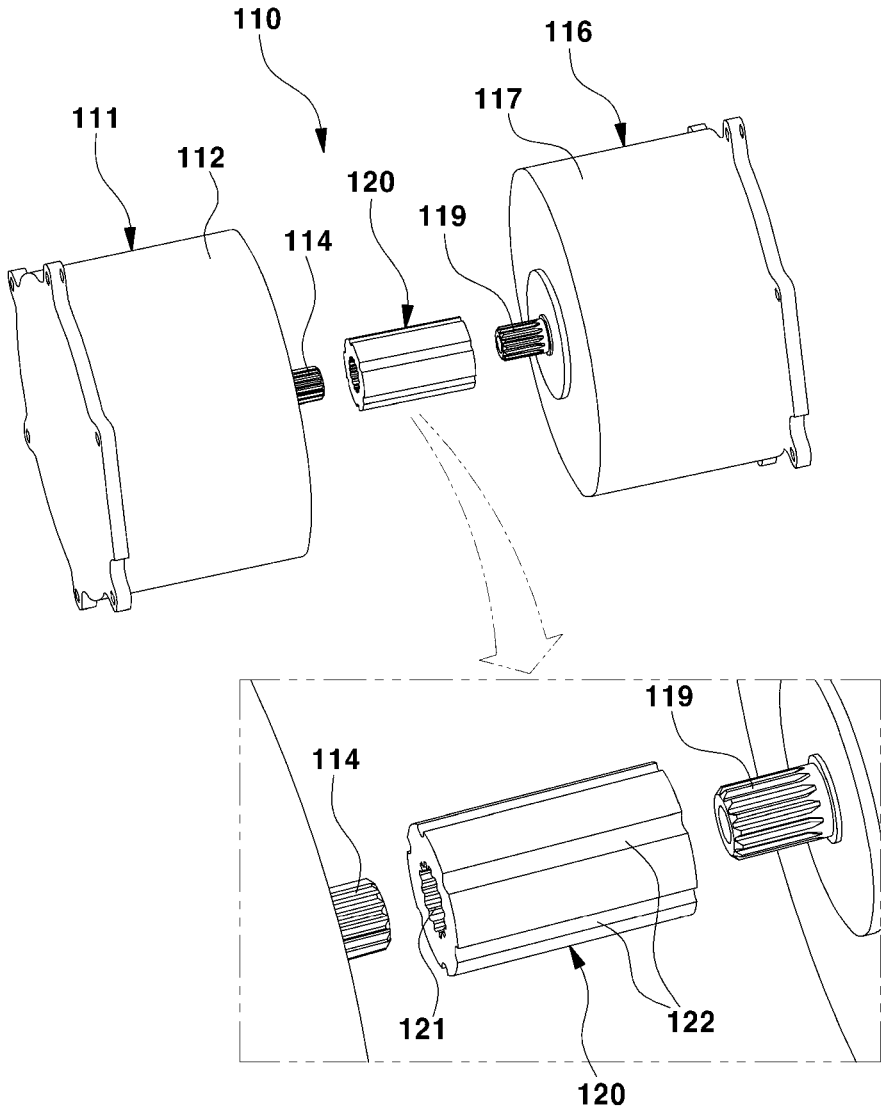
FIG. 7 is a schematic diagram illustrating a connection structure of a rotor shaft between motors in an example of a cooling fan.

FIG. 6 is a perspective view illustrating a cooling fan, and FIG. 7 is a schematic diagram illustrating a connection structure of a rotor shaft between motors in the cooling fan. In FIG. 6, the shroud and the inverter are omitted.

Figure 8:
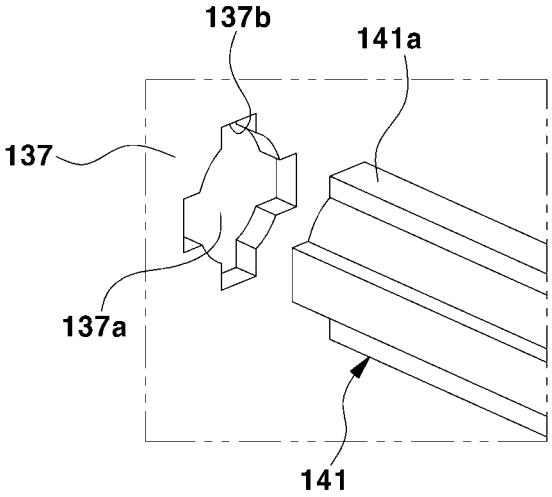
FIG. 8 is a perspective view illustrating a coupling structure between a central shaft of a blade and a fan-side gear in an example of a cooling fan.
Figure 9:
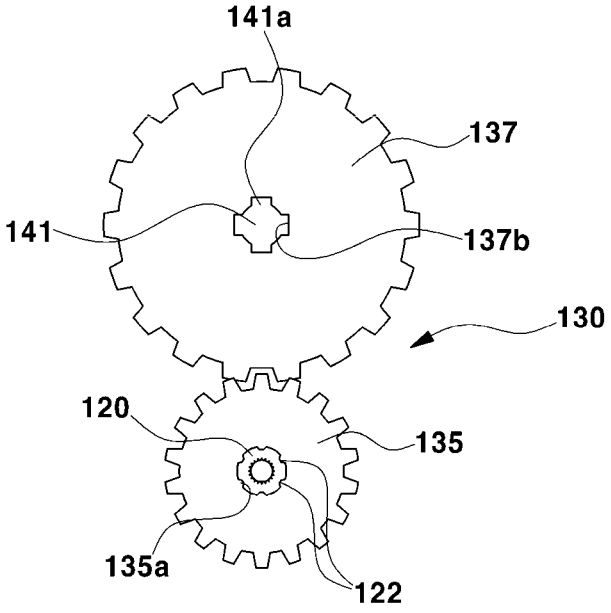
FIG. 9 is a schematic diagram illustrating an example of a gear device as an overdrive power transmission mechanism in the cooling fan.

FIG. 8 is a perspective view illustrating a coupling structure between a connection shaft and a gear in the cooling fan, and FIG. 9 is a schematic diagram illustrating a gear device as an overdrive power transmission mechanism in the cooling fan.

In the implementation illustrated in FIG. 6, a gear-type power transmission mechanism may be used as a power transmission mechanism 130 for transmitting the rotational force of an electric motor 110 composed of a dual motor (first motor and second motor) to a blade (fan) 140. That is, a gear device is configured between an output shaft of the electric motor 110 and a central shaft 141 of a blade 140.

In addition, in configuring the gear device, gears having a predetermined gear ratio are used to implement an overdrive function. The gear device may be configured to include a motor-side gear 135 mounted on the output shaft of the electric motor 110 to rotate integrally, and a fan-side gear 137 mounted on the central shaft 141 of the blade 140 to rotate integrally.

In this case, the motor-side gear 135 and the fan-side gear 137 may be directly meshed, and the fan-side gear 137 may have a larger diameter having more teeth than the motor-side gear 135.

Referring to FIG. 6, a mounting member 210 coupled to a radiator 200 of a cooling module can be seen. The mounting member 210 is a member that is also coupled to a vehicle frame that is a vehicle body part in a state of being coupled to the radiator 200.

The mounting member 210 is a member for fixing and mounting the radiator 200 on the vehicle body frame, and the fan mounting bracket 160 is wholly fixed to the mounting member 210 by coupling an end of a rod 161 of the fan mounting bracket 160 to the mounting member 210. In addition, the central shaft 141 of the blade 140 is coupled to be rotatably supported by a bracket body 162 of the fan mounting bracket 160 with the bearing interposed therebetween.

Accordingly, the rotational force output from the output shaft of the electric motor 110 may be transmitted to the blade 140 through the motor-side gear 135 and the fan-side gear 137 so that the blade 140 can rotate with the rotational force of the electric motor 110. In addition, since the diameter and the number of teeth of the fan-side gear 137 are larger than the diameter and the number of teeth of the motor-side gear 135, the overdrive function may be implemented when the rotational force of the electric motor 110 is transmitted.

That is, similar to the case of using the belt pulley device, the torque is increased when the torque is transmitted from the motor-side gear 135 to the fan-side gear 137, and compared to the output torque of the electric motor 110 composed of a dual motor, the increased torque may be transmitted so as to act on the blade 140, so that it is possible to drive the blade (fan) 140 with a target high-output.

Further, although the electric motor 110 may have the same configuration as the implementation of FIGS. 2 to 4, the coupling structure between the first motor 111 and the second motor 116 may be modified. That is, as illustrated in FIG. 7, in a state in which the output sides of the first motor 111 and the second motor 116 are arranged to face each other, the rotor shafts 114 and 119 of the two motors 111 and 116 may be coupled in a space between the two motors.

In some examples, the rotor shafts 114 and 119 of the two motors 111 and 116 may be able to rotate integrally with each other. To this end, a connection shaft 120 is installed between the two rotor shafts 114 and 119 on both sides to integrally connect the two rotor shafts.

The distance between the two motors 111 and 116 may be minimized within a tolerable range for reduction in material cost and weight, and the rotor shafts 114 and 119 and the connection shaft 120 are connected in a spline-coupling manner in order to prevent a loss due to friction from occurring.

That is, the connection shaft 120 has a hollow shaft shape, and teeth 121 are formed on an inner circumferential surface of the connection shaft 120. In assembly, the rotor shaft 114 of the first motor 111 and the rotor shaft 119 of the second motor 116 may be inserted into and spline-coupled to both ends of the connection shaft 120. To this end, the inner circumferential surface of the connection shaft 120 and the outer circumferential surfaces of the two rotor shafts 114 and 119 on both sides are provided with teeth for the spline-coupling therebetween.

Accordingly, the rotor shaft 114 of the first motor 111 and the rotor shaft 119 of the second motor 116 are connected to rotate integrally via the connection shaft 120, and the rotational force of the two motors 111 and 116 can be output through the two rotor shafts 114 and 119 on both sides and the connection shaft 120.

In addition, the motor-side gear 135 is mounted on the outer circumferential surface of the connection shaft 120 such that the motor-side gear 135 is coupled to and mounted on the connection shaft 120 to rotate integrally, which makes it possible to transmit the rotational force output from the two motor 111 and 116 to the motor-side gear 135 via the connection shaft 120. Accordingly, the output shaft of the electric motor 110 via which the rotational force is output becomes the connection shaft 120.

The motor-side gear 135 is coupled to and mounted on the outer circumferential surface of the connection shaft 120 by a coupling structure in which grooves 122 and protrusions 135*a* are engaged, as illustrated in FIGS. 7 and 9, that is, a spline-coupling structure similar to the coupling structure between the rotor shafts 114 and 119 and the connection shaft 120, so as to rotate integrally with each other.

In some examples, the inverter may be mounted on the rear side of the motor housings 112 and 117 of the motors 111 and 116. In some examples, where the two motors 111 and 116 are made to face each other and the two rotor shafts 114 and 119 on both sides are connected by the connection shaft 120 as illustrated in FIG. 7, such a configuration has a non-penetrating structure in which neither of the two rotor shafts 114 and 119 pass through the inverter.

In the implementation of FIG. 7, the two motors 111 and 116 are controlled by a controller so as to be driven such that the rotor shafts 114 and 119 rotate in opposite directions and that the rotational force and torque thereof are output with the same magnitude. Accordingly, the connection shaft 120 receives the rotational force and torque output with the same magnitude from the two motors 111 and 116 via the rotor shafts 114 and 119. In particular, the rotational force and torque of the two motors 111 and 116 are transmitted in a combined magnitude to the connection shaft 120 so as to rotate the motor-side gear 135.

Referring to FIG. 8, it can be seen that the central shaft 141 of the blade 140 is coupled to pass through a central hole 137*a* of the fan-side gear 137. Here, since the fan-side gear 137 may be connected to the central shaft 141 of the blade 140 to rotate integrally with each other, the fan-side gear 137 and the central shaft 141 of the blade 140 may be assembled by a coupling structure in which groove 137*a* and protrusions 141*a* are engaged, similar to the coupling structure between the connection shaft 120 and the motor-side gear 135.

FIG. 9 illustrates an example in which the motor-side gear 135 and the fan-side gear 137 are meshed in a circumscribed manner. As illustrated, in the gear-type power transmission mechanism 130 for transmitting the rotational force of the electric motor 110 to the blade 140, although the gear device may be composed of the motor-side gear 135 and the fan-side gear 137 that are circumscribed as described above, the gear device may be composed of a combination of other various types of gears.

That is, so long as it can implement an overdrive function enabling the torque of the electric motor 110 to be increased and transmitted to the blade 140, in addition to the above-described circumscribed gear-type gear device, a gear device having a plurality of inscribed gears, a gear device having a planetary gear configuration, etc. may be employed.

In the example of the overdrive mechanism illustrated in FIG. 9, that is, in the example of the gear device having an input gear (motor-side gear) 135 and an output gear (fan-side gear) 137 with a larger diameter and the number of teeth than those of the input gear (motor-side gear) 135, the increased torque transmitted to the blade can also be obtained using Equation 1.

However, in Equation 1, $T_{Fan}$ is a torque transmitted to the fan-side gear 137 and acting on the blade 140, $T_{Motor}$ is a torque of the motor-side gear 135, d1 is the number of teeth (or diameter) of the motor-side gear 135, and d2 is the number of teeth (or diameter) of the fan-side gear 137.

As described in the foregoing, the cooling fan according to the implementations of the present disclosure has been described in detail. According to the vehicle cooling fan of the present disclosure, it is possible to drive the fan (blade) at high speed and high power and to, when applied to a large-scale radiator, obtain sufficient air volume and cooling performance, using the electric motor while even using the single fan (blade) that can minimize the dead zone.

Compared to the conventional case of applying a hydraulically driven cooling fan for a large-scale radiator, complex hydraulic parts can be omitted, so there are several advantages such as reduction in the number of parts, weight reduction, improvement of a packaging feature, and ease of securing an installation space.

In particular, as a number of hydraulic components disposed behind the cooling fan are eliminated, it is possible to improve both the flow resistance of air having passed through the radiator and the cooling performance. In addition, compared to a hydraulically driven cooling fan, driving efficiency is improved to minimize consumed fan output and improve vehicle fuel efficiency.

While the implementations of the present disclosure have been described in detail in the foregoing, the scope of the present disclosure is not limited thereto, and various modifications and improvements made by those skilled in the art using the basic concept of the present disclosure as defined in the following claims are also included in the scope of the present disclosure.

What is claimed is:

1. A cooling fan configured to suction air from a cooling module of a vehicle and to cause the suctioned air to pass through a heat exchanger of the cooling module, the cooling fan comprising:

an electric motor, the electric motor comprising an output shaft configured to output rotational force;

a blade configured to be rotated by the rotational force of the electric motor, the blade comprising a central shaft; and a power transmission mechanism disposed between the output shaft of the electric motor and the central shaft of the blade and configured to transmit the rotational force of the electric motor to the blade, wherein the electric motor comprises:

a first motor configured to rotate a first rotor shaft and to output a first rotational force component, and a second motor configured to rotate a second rotor shaft in a rotational direction of the first rotor shaft and to output a second rotational force component, the second rotor shaft being separately formed from the first rotor shaft and detachably connected to the first rotor shaft, and wherein the output shaft is a single output shaft of the electric motor that is configured to receive and combine the first and second rotational force components through the first and second rotor shafts and to output the combined rotational force components of the first motor and the second motor to the power transmission mechanism.

2. The cooling fan according to claim 1, wherein the first rotor shaft and the second rotor shaft are directly connected to each other and configured to rotate integrally, and wherein the second rotor shaft is the output shaft.

3. The cooling fan according to claim 2, wherein an end of the first rotor shaft and an end of the second rotor shaft are spline-coupled to each other to thereby enable the first rotor shaft and the second rotor shaft to rotate integrally.

4. The cooling fan according to claim 2, wherein the first motor and the second motor are arranged in a front-rear direction, wherein each of the first motor and the second motor comprises:

a motor housing, an inverter disposed at a surface of the motor housing, and wherein one or both of the first rotor shaft and the second rotor shaft pass through the inverter of the second motor.

5. The cooling fan according to claim 1, wherein the electric motor further comprises a connection shaft that connects the first rotor shaft and the second rotor shaft to each other, and wherein the connection shaft is the output shaft.

6. The cooling fan according to claim 5, wherein the first motor and the second motor are arranged in a front-rear direction, wherein output sides of the first motor and the second motor face each other, and wherein the connection shaft is disposed in a space between the first motor and the second motor.

7. The cooling fan according to claim 6, wherein each of the output sides of the first motor and the second motor defines outer teeth at an outer surface thereof, and wherein the connection shaft receives the output sides of the first motor and the second motor, the connection shaft defining inner teeth at an inner surface thereof coupled to the outer teeth.

8. The cooling fan according to claim 5, wherein the first rotor shaft and the connection shaft are spline-coupled and configured to rotate integrally, and wherein the second rotor shaft and the connection shaft are spline-coupled and configured to rotate integrally.

9. The cooling fan according to claim 1, further comprising a cross member that supports the first motor and the second motor, the cross member extending in a front-rear direction of the vehicle and being connected to body frames arranged on left and right sides of the vehicle.

10. The cooling fan according to claim 1, wherein the power transmission mechanism comprises an overdrive mechanism configured to increase a torque of the electric motor and to transmit the increased torque to the blade.

11. The cooling fan according to claim 1, wherein the power transmission mechanism comprises:

a motor-side pulley disposed at the output shaft of the electric motor;

a fan-side pulley disposed at the central shaft of the blade; and a belt that connects the motor-side pulley to the fan-side pulley and is configured to transmit the rotational force therebetween, and wherein a diameter of the fan-side pulley is larger than a diameter of the motor-side pulley.

12. The cooling fan according to claim 1, wherein the power transmission mechanism comprises:

a motor-side gear disposed at the output shaft of the electric motor; and a fan-side gear disposed at the central shaft of the blade and configured to receive the rotational force from the motor-side gear, and wherein a diameter of the fan-side gear is larger than a diameter of the motor-side gear, and wherein a number of teeth of the fan-side gear is greater than a number of teeth of the motor-side gear.

13. A cooling fan configured to suction air from a cooling module of a vehicle and to cause the suctioned air to pass through a heat exchanger of the cooling module, the cooling fan comprising:

an electric motor, the electric motor comprising an output shaft configured to output rotational force;

a blade configured to be rotated by the rotational force of the electric motor, the blade comprising a central shaft; and a power transmission mechanism disposed between the output shaft of the electric motor and the central shaft of the blade and configured to transmit the rotational force of the electric motor to the blade, wherein the electric motor comprises:

a first motor configured to rotate a first rotor shaft and to output a first rotational force component, and a second motor configured to rotate a second rotor shaft in a rotational direction of the first rotor shaft and to output a second rotational force component, the second rotor shaft being separately formed from the first rotor shaft and detachably connected to the first rotor shaft, and wherein the output shaft is a single output shaft of the electric motor that is configured to receive and combine the first and second rotational force components through the first and second rotor shafts and to output the combined rotational force components of the first motor and the second motor to the power transmission mechanism, and wherein the power transmission mechanism comprises an overdrive mechanism configured to mechanically connect the output shaft of the electric motor and the central shaft of the blade and configured to increase a torque of the electric motor and to transmit the increased torque to the blade.

* * * * *